US009243754B2

(12) United States Patent
Weickert et al.

(10) Patent No.: US 9,243,754 B2
(45) Date of Patent: Jan. 26, 2016

(54) METHOD OF CHARGING A SORPTION STORE WITH A GAS

(71) Applicant: BASF SE, Ludwigshafen (DE)

(72) Inventors: Mathias Weickert, Ludwigshafen (DE); Stefan Marx, Dirmstein (DE); Ulrich Müller, Neustadt (DE); Peter Renze, Mannheim (DE); Christian-Andreas Winkler, Mannheim (DE)

(73) Assignee: BASF SE, Ludwigshafen (DE)

( * ) Notice: Subject to any disclaimer, the term of this patent is extended or adjusted under 35 U.S.C. 154(b) by 142 days.

(21) Appl. No.: 14/048,223

(22) Filed: Oct. 8, 2013

(65) Prior Publication Data

US 2014/0097098 A1 Apr. 10, 2014

Related U.S. Application Data

(60) Provisional application No. 61/711,236, filed on Oct. 9, 2012.

(51) Int. Cl.
*F17C 11/00* (2006.01)

(52) U.S. Cl.
CPC ..... *F17C 11/005* (2013.01); *F17C 11/00* (2013.01); *F17C 11/007* (2013.01)

(58) Field of Classification Search
CPC ..... F17C 11/00; F17C 11/005; F17C 11/007; B01D 53/02; B01D 53/04
USPC ..... 95/90; 96/108, 146; 206/0.7; 502/526; 423/648.1, 658.2; 429/515; 141/4
See application file for complete search history.

(56) References Cited

U.S. PATENT DOCUMENTS

| | | | | |
|---|---|---|---|---|
| 4,165,569 | A * | 8/1979 | Mackay | 34/416 |
| 4,859,427 | A * | 8/1989 | Konishi et al. | 422/159 |
| 4,964,524 | A * | 10/1990 | Halene | 220/586 |
| 6,626,323 | B2 * | 9/2003 | Stetson et al. | 220/577 |
| 6,638,348 | B2 * | 10/2003 | Kuriiwa et al. | 96/146 |

(Continued)

FOREIGN PATENT DOCUMENTS

| | | |
|---|---|---|
| CN | 101495796 | 7/2009 |
| CN | 101680600 | 3/2010 |

(Continued)

OTHER PUBLICATIONS

Wärmeleitung und Dispersion in durchströmten Schüttungen, *VDI Wärmeatlas*, vol. 10, Sec. Mh3 2006, 4 pages.
English Machine Translation of "Wärmeleitung und Dispersion in durchströmten Schüttungen, VDI Wärmeatlas, vol. 10, Sec. Mh3 2006," 6 pages.

(Continued)

*Primary Examiner* — Frank Lawrence
(74) *Attorney, Agent, or Firm* — Servilla Whitney LLC

(57) ABSTRACT

Described is a method of charging a sorption store with a gas. The sorption store comprises a closed container which is at least partly filled with an adsorption medium and has an inlet and an outlet which can each be closed by a shut-off element. The method comprises the steps: (a) closing of the outlet shut-off element and opening of the inlet shut-off element, (b) introduction of gas to be stored under a predetermined pressure through the inlet, (c) rapid opening of the outlet shut-off element with the inlet shut-off element open so that a gas flow having a predetermined flow rate is established in the container, (d) reduction of the flow rate as a function of the adsorption rate of the gas adsorbed in the store, and (e) complete closing of the outlet shut-off element.

12 Claims, 5 Drawing Sheets

(56) References Cited

U.S. PATENT DOCUMENTS

| | | | | |
|---|---|---|---|---|
| 7,320,726 | B2 * | 1/2008 | Shih et al. | 96/154 |
| 7,323,043 | B2 * | 1/2008 | Finamore | 96/146 |
| 7,651,554 | B2 * | 1/2010 | Tan et al. | 96/108 |
| 7,652,132 | B2 | 1/2010 | Yaghi et al. | |
| 8,057,584 | B2 | 11/2011 | Schubert et al. | |
| 8,197,988 | B2 * | 6/2012 | Kim et al. | 429/515 |
| 2008/0020250 | A1 | 1/2008 | Schuetz et al. | |
| 2008/0168776 | A1 * | 7/2008 | Arnold et al. | 62/46.1 |
| 2010/0133280 | A1 | 6/2010 | Stein et al. | |
| 2010/0219087 | A1 * | 9/2010 | Fujita et al. | 206/0.7 |

FOREIGN PATENT DOCUMENTS

| | | |
|---|---|---|
| WO | WO-2005/044454 | 5/2005 |
| WO | WO-2008/075291 | 6/2008 |

OTHER PUBLICATIONS

Zhao, Zhenxia et al., Adsorption and Diffusion of Carbon Dioxide on Metal-Organic Framework (MOF-5), *Ind. Eng. Chem. Res.*, vol. 48, No. 22 2009, 10015-10020.

PCT International Search Report in PCT/IB2013/059194, mailed Feb. 6, 2014, 3 pages.

* cited by examiner

METHOD OF CHARGING A SORPTION STORE WITH A GAS

CROSS-REFERENCE TO RELATED APPLICATIONS

This application claims the benefit of priority under 35 U.S.C. §119(e) to U.S. Provisional Application No. 61/711,236, filed Oct. 9, 2012, the entire content of which is incorporated herein by reference in its entirety.

TECHNICAL FIELD

The present invention relates to a sorption store for storing gaseous substances, which comprises a closed container, a feed device comprising an inlet in the container wall and an inlet shut-off element and has an outlet having an outlet shut-off element in the container wall. The invention further relates to a method of filling a sorption store with a gas where the sorption store comprises a closed vessel which is at least partly filled with an adsorption medium and has an inlet and an outlet which can each be closed by means of a shut-off element.

BACKGROUND

To store gases for stationary and mobile applications, sorption stores are increasingly being used nowadays in addition to pressurized gas tanks. Sorption stores generally comprise an adsorption medium having a large internal surface area on which the gas is adsorbed and thereby stored. During filling of a sorption store, heat is liberated as a result of the adsorption and has to be removed from the store. Analogously, heat has to be supplied for the process of desorption when taking gas from the store. Heat management is therefore of great importance in the design of sorption stores.

The patent application U.S. 2008/0168776 A1 describes a sorption store for hydrogen which comprises an external container which is thermally insulated from the surroundings and in the interior of which a plurality of pressure containers comprising an adsorption medium are arranged. The intermediate spaces between the pressure containers are filled with a cooling liquid in order to be able to remove the heat evolved during adsorption.

The patent application WO 2005/044454 A2 describes an apparatus for storing gaseous hydrocarbons, which comprises a container filled with an adsorption medium. An external circuit for the gas to be stored and in which the gas stream is cooled in order to remove heat evolved in the adsorption is provided.

A disadvantage of known sorption stores is that filling with gas proceeds only slowly. Especially in the case of mobile applications, for example in motor vehicles, this disadvantage is particularly serious.

SUMMARY

A first embodiment pertains to a method of charging a sorption store with a gas, wherein the sorption store comprises a closed container which is at least partly filled with an adsorption medium and has an inlet and an outlet which can each be closed by a shut-off element. The method comprises the steps: (a) closing of the outlet shut-off element and opening of the inlet shut-off element, (b) introduction of the gas to be stored under a predetermined pressure through the inlet, (c) rapid opening of the outlet shut-off element with the inlet shut-off element open so that a gas flow having a predetermined flow rate is established in the container, (d) reduction of the flow rate as a function of the adsorption rate of the gas adsorbed in the store, and (e) complete closing of the outlet shut-off element.

In a second embodiment, the method of the first embodiment is modified, wherein the container has at least two parallel, channel-shaped subchambers which are each at least partly filled with the adsorption medium and whose channel walls are cooled in its interior.

In a third embodiment, the method of the first and second embodiments is modified, wherein wherein the channel walls of the channel-shaped subchambers are configured as double walls and a heat transfer medium flows through them.

In a fourth embodiment, the method of first through third embodiments is modified, wherein the spacing of the channel walls in each channel-shaped subchamber is from 2 cm to 8 cm.

In a fifth embodiment, the method of the first through fourth embodiments is modified, wherein the gas stream flowing into the container or out of the container is measured by means of a flow sensor and the flow rate of the gas in the container is set as a predetermined multiple of the adsorption rate over time.

In a sixth embodiment, the method of the first through fifth embodiments is modified, wherein the predetermined multiple is from 1.5 to 100.

In a seventh embodiment, the method of the first through sixth embodiments is modified, wherein the temperature of the gas stream is measured at at least one point in the interior of the container and is matched to the flow rate of the gas in the container when required in such a way that a predetermined maximum temperature is not exceeded.

In an eighth embodiment, the method of the first through seventh embodiments is modified, wherein the porosity of the adsorption medium is at least 0.2.

In a ninth embodiment, the method of the first through eighth embodiments is modified, wherein the adsorption medium is present as a bed of pellets and the ratio of the permeability of the pellets to the smallest pellet diameter is at least $10^{-14}$ $m^2/m$.

In a tenth embodiment, the method of the first through ninth embodiments is modified, wherein the adsorption medium is selected from zeolite, activated carbon, or metal organic frameworks.

A second aspect of the invention pertains to a sorption store for storing gaseous substances. In an eleventh embodiment, a sorption store for storing gaseous substances comprises a closed container, a feed device comprising an inlet in the container wall and an inlet shut-off element and an outlet having an outlet shut-off element in the container wall, wherein the container has at least one separation element which is located in its interior and is configured so that the interior of the container is divided into at least two parallel, channel-shaped subchambers which are at least partly filled with an adsorption medium and whose channel walls are coolable, where, viewed in cross section, the contours of the interior wall of the container and the at least one separation element and optionally the plurality of separation elements is/are essentially conformal.

In a twelfth embodiment, the sorption store of the eleventh embodiment is modified, wherein the container is cylindrical and the at least one separation element is arranged essentially coaxially to the axis of the cylinder.

In a thirteenth embodiment, the sorption store of the twelfth embodiment is modified, wherein the at least one separation element is configured as a tube so that the interior of the tube forms a first channel-shaped subchamber and the space between the outer wall of the tube and the inner wall of the container or, optionally, between the outer wall of the tube and a further separation element forms a second, annular channel-shaped subchamber.

In a fourteenth embodiment, the sorption store of the eleventh through thirteenth embodiments is modified, wherein a heat transfer medium whose temperature is greater than the temperature of the gas in the channel-shaped subchambers flows through the channel walls.

In a fifteenth embodiment, the method of the first through fifth embodiments embodiment is modified, wherein the predetermined multiple is from 3 to 40.

In a sixteenth embodiment, the method of the fifteenth embodiment is modified, wherein the temperature of the gas stream is measured in at least one channel-shaped subchamber and is matched to the flow rate of the gas in the container when required in such a way that a predetermined maximum temperature is not exceeded.

DETAILED DESCRIPTION

Figure 2:
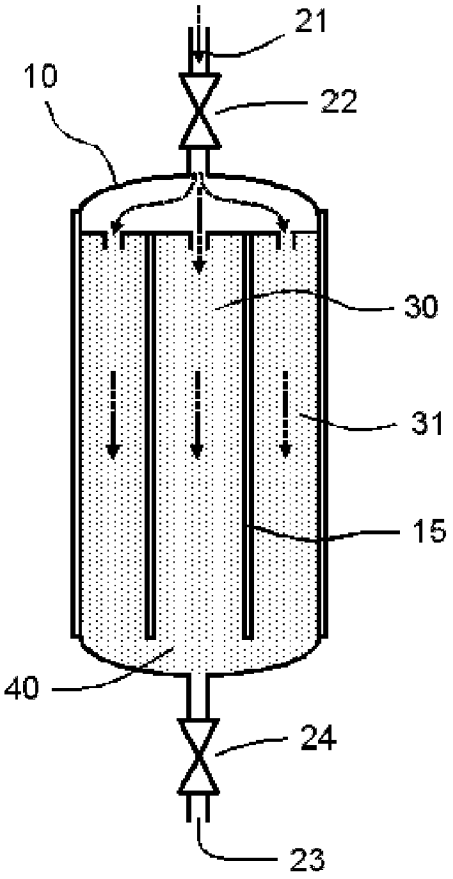
FIG. 2 depicts an embodiment of a sorption store according to the invention.

Before describing several exemplary embodiments of the invention, it is to be understood that the invention is not limited to the details of construction or process steps set forth in the following description. The invention is capable of other embodiments and of being practiced or being carried out in various ways.

Provided is a method of storing gaseous substances which allows fast charging of gas and improved taking-off of gas. The apparatus according to one aspect of the invention has a simple construction and requires little electric energy during operation. Further provided is a method of quickly and efficiently charging the store and removing gas from the store.

According to one or more embodiments of a first aspect of the present invention, the method of the invention is carried out using a sorption store which comprises a closed container having an inlet and an outlet which can each be closed by means of a shut-off element. The container is at least partly filled with an adsorption medium. In one or more embodiments, the method of the invention comprises the following steps:

(a) closing of the outlet shut-off element and opening of the inlet shut-off element, (b) introduction of gas to be stored under a predetermined pressure through the inlet, (c) rapid opening of the outlet shut-off element with the inlet shut-off element open so that a gas flow having a predetermined flow rate is established in the container, (d) reduction of the flow rate as a function of the adsorption rate of the gas adsorbed in the store and (e) complete closing of the outlet shut-off element.

Sorption stores as are known from the prior art are, for charging, usually connected to a pressure line from which the gas to be stored flows at constant pressure into the store until a predetermined final pressure in the store has been reached. However, it has been found that the time required for charging can be significantly reduced when charging is carried out according to the method of the invention.

In the sorption store, gas is stored both by adsorption on the adsorption medium and also in the voids between and in individual particles of the adsorption medium or in regions of the container which are not filled with adsorption medium. According to one or more embodiments, during step (b) of the method of the invention, the voids are firstly filled with gas. The pressure in the store follows, with virtually no lag time, the pressure of the gas flowing into the container. In one or more embodiments, to minimize the total time required for the charging operation, this first step should be carried out as quickly as possible, by the gas being introduced at the pressure which is prescribed as final pressure at the end of the charging operation.

According to one or more embodiments, during step (b), part of the gas is adsorbed, resulting in the temperature of the adsorption material and thus also that of the surrounding gas rising. Due to the rapid opening of the outlet shut-off element with the inlet shut-off element continuing to be open in step (c), a gas flow is generated in the vessel and this flows over the adsorption medium and ensures transport of the heat evolved as a result of the adsorption from the container. In addition, the gas flow increases the thermal conductivity of the adsorption medium, which likewise contributes to more rapid removal of the heat.

The more gas is adsorbed on the adsorption medium, the more heat is liberated. With increasing loading of the adsorption medium, the amount of gas which can be adsorbed per unit time decreases. The amount of gas adsorbed per unit time is referred to as the adsorption rate. It has been found to be advantageous to reduce the flow rate of the gas stream in the container over time as a function of the adsorption rate (step d). At the end of the method according to the invention, the outlet shut-off element is closed.

According to one or more embodiments, the adsorption rate can be derived from the adsorption kinetics. As used herein, the term adsorption kinetics refers to the course of adsorption of the gas on the adsorption medium over time under isothermal and isobaric conditions. Methods of determining the adsorption kinetics are known to those skilled in the art, for example by means of pressure jump experiments or adsorption balances (e.g. in "Zhao, Li and Lin, Industrial & Engineering Chemistry Research, 48(22), 2009, pages 10015-10020").

According to one or more embodiments, the course of the adsorption kinetics can frequently be approximated by an exponentially decaying function which at the beginning displays a sharp rise and then becomes ever flatter as it converges toward a final value. An example of such an approximation is the function $a\cdot(1-e^{-bt})$, where a and b are positive constants. The adsorption kinetics can also be approximated by other functions, for example a concave function, a function which is constant in sections, a function which is linear in sections or a linear function which joins the initial value and the final value. Approximation functions can be determined for the adsorption rate in this way.

In one or more embodiments of the method of the invention, the gas stream flowing in the container or from the container is measured by means of a flow sensor and the flow rate of the gas in the container is set as a predetermined multiple of the adsorption rate over time. In one or more embodiments, the multiple is from 1.5 to 100, specifically from 3 to 40. At excessively small values of the multiple, there is a risk of the heat not being able to be removed sufficiently. At very high values, an unnecessarily large quantity of energy has to be expended in order to ensure the high flow without an adequate gain in respect of heat removal being able to be achieved.

In one or more embodiments of the method of the invention, the temperature of the gas stream is measured at at least one point in the interior of the container and the flow rate of the gas in the container is, if necessary, adjusted so that a predetermined maximum temperature is not exceeded. In specific embodiments, the temperature is measured in at least one channel-shaped subchamber.

According to one or more embodiments, the adjustment of the flow rate is carried out by varying the degree of opening of the outlet shut-off element. In specific embodiments, the shut-off elements are configured as regulating valves, in particular the outlet shut-off element.

In an advantageous embodiment of the method of the invention, the inflowing gas is cooled before being fed in, in particular with a constant temperature. In one or more embodiments, the gas exiting from the outlet is recirculated in a circulation circuit to the inlet. In the circulation circuit, the gas is advantageously compressed and cooled; appropriate apparatuses such as compressors, pumps and heat exchangers are known to those skilled in the art.

According to one or more embodiments, various materials are suitable as adsorption medium. In one or more embodiments, the adsorption medium comprises zeolite, activated carbon, or metal organic frameworks.

In one or more embodiments, the porosity of the adsorption medium is at least 0.2. As used herein, the porosity is defined as the ratio of void volume to total volume of any subvolume in the container. At a low porosity, the pressure drop on flowing through the adsorption medium increases, which has an adverse effect on the charging time.

In one or more embodiments of the invention, the adsorption medium is present as a bed of pellets and the ratio of permeability of the pellets to the smallest pellet diameter is at least $10^{-14}$ $m^2/m$. The rate at which the gas penetrates into the pellets during charging depends on the speed at which the pressure in the interior of the pellets approaches the pressure on the outside of the pellets. The time required for this pressure equalization and, thus, also the loading time of the pellets increases with decreasing permeability and with increasing diameter of the pellets. This can have a limiting effect on the total process of charging and discharging.

In one or more embodiments of the method of the invention, the container has at least two parallel, channel-shaped subchambers which are each at least partly filled with the adsorption medium and whose channel walls are cooled in its interior.

In one or more embodiments, the at least one separation element or a plurality of separation elements, in particular all separation elements present, have a double wall so that a heat transfer medium can flow through them. In specific embodiments, preference is also given to all channel walls of the channel-shaped subchambers being double walls to allow a heat transfer medium to flow through them. Depending on the arrangement of the at least one separation element or the plurality of separation elements, a section of the interior wall of the container forms a channel wall of a channel-shaped subchamber or a plurality of channel-shaped subchambers. In this case too, the container wall is, in one or more embodiments, a double wall. In a specific embodiment, the entire container wall including the end faces is configured so as to allow a heat transfer medium to flow through it, in particular configured as a double wall.

Depending on the temperature range which is suitable for the cooling or heating of the gas in the sorption store, various heat transfer media, for example water, glycols, alcohols or mixtures thereof, are possible. Appropriate heat transfer media are known to those skilled in the art.

According to one or more embodiments, it has been found to be advantageous for the spacing of the channel walls in each channel-shaped subchamber to be from 2 cm to 8 cm. Here, the term spacing refers to the shortest distance between two points on opposite walls viewed in cross section perpendicular to the axis of the channel. In the case of a channel having a circular cross section, for example, the spacing corresponds to the diameter, in the case of an annular cross section it corresponds to the width of the annulus and in the case of a rectangular cross section it corresponds to the shorter of the distances between the parallel sides. Particularly when all channel walls are cooled or heated, the range mentioned has been found to be a good compromise between heat transfer and fill volume of the adsorption medium. At greater spacings, heat transfer between adsorption medium and wall deteriorates, and in the case of smaller spacings the fill volume of the adsorption medium at given external dimensions of the container decreases. In addition, the weight of the sorption store and its production costs increase, which is disadvantageous, in particular in the case of mobile applications.

In one or more embodiments, the spacings of the channel walls in the channel-shaped subchambers differ by not more than 40%, specifically by not more than 20%. Such a configuration aids uniform removal of heat during charging and introduction of heat during emptying of the container.

In a specific embodiment, the cross-sectional areas of the channel-shaped subchambers are selected so that, during charging of the container with gas, the flow velocities in the channel-shaped subchambers differ by not more than 20% per channel pair. In very specific embodiments, particular preference is given to the flow velocities in all channel-shaped subchambers differing by not more than 20%.

The requirements for very uniform wall spacings and very uniform cross-sectional areas of the channel-shaped subchambers which have been mentioned can, depending on the specific geometric configuration of the container, be contradictory. In such a case, the configuration having very uniform wall spacings is preferred, since the effect of uniform heat removal is more important than the flow effect during emptying of the container.

In one or more embodiments of the method of the invention of filling the store, the flow effect is of primary importance. In the case of locally different flow velocities in the container, for example in the case of a plurality of channel-shaped subchambers having different cross-sectional areas, the minimum flow velocity limits the maximum charging of the container in a given time or limits the duration of charging at a given fill amount of gas.

In an advantageous embodiment, the inflowing gas is conveyed through a perforated inflow tube or through a plurality of perforated inflow tubes into the adsorption medium. This results in a more uniform gas flow and a more homogeneous temperature distribution in the adsorption medium.

In one or more embodiments, the container of the sorption store is cylindrical, and the at least one separation element is arranged essentially coaxially to the axis of the cylinder.

Embodiments in which the longitudinal axis of the at least one separation element is inclined by a few degrees up to a maximum of 10 degrees relative to the axis of the cylinder are considered to be "essentially" coaxial. This configuration ensures that the channel cross sections vary only slightly along the axis of the cylinder, so that uniform flow over the length of the channel can be established.

Depending on the space available for installation and the maximum permissible pressure in the container, various cross-sectional areas for the cylindrical container are possible, for example circular, elliptical or rectangular. Irregularly shaped cross-sectional areas are also possible, e.g. when the container is to be fitted into a hollow space of a vehicle body. Circular and elliptical cross sections are particularly suitable for high pressures above about 100 bar.

The invention further provides a sorption store for storing gaseous substances, which comprises a closed container, a feed device comprising an inlet in the container wall and an inlet shut-off element and an outlet having an outlet shut-off element in the container wall. In one or more embodiments, the container has at least one separation element which is located in its interior and is configured so that the interior of the container is divided into at least two parallel, channel-shaped subchambers which are at least partly filled with an adsorption medium and whose channel walls are coolable. According to the invention, viewed in cross section, the contours of the interior wall of the container and the at least one separation element and optionally the plurality of separation elements is/are essentially conformal.

As used herein, conformal means that the contours have the same shape, for example all circular, all elliptical or all rectangular. As used herein, the expression "essentially conformal" means that small deviations from the basic shape are still encompassed by "the same shape". Examples are round corners in the case of a rectangular basic shape or deviations within manufacturing tolerances.

Such a configuration allows optimal utilization of the interior space of the container with a view to a very large amount of adsorption medium combined with efficient heating management.

The above-described structural features such as the double-walled separation elements, spacings of the channel walls and/or the coaxial arrangement of the separation elements in a cylindrical container also represent specific embodiments of the sorption store of the invention.

In one or more embodiments, the choice of the wall thickness of the container and of the separation elements depends on the maximum pressure to be expected in the container, the dimensions of the container, in particular its diameter, and the properties of the material used. In the case of an alloy steel container having an external diameter of 10 cm and a maximum pressure of 100 bar, the minimum wall thickness has, for example, been estimated at 2 mm (in accordance with DIN 17458). The internal spacing of the double walls is selected so that a sufficiently large volume flow of the heat transfer medium can flow through them. It is preferably from 2 mm to 10 mm, particularly preferably from 3 mm to 6 mm.

In one or more embodiments, the at least one separation element is configured as a tube so that the interior space of the tube forms a first channel-shaped subchamber and the space between the outer wall of the tube and the interior wall of the container or optionally between the outer wall of the tube and a further separation element forms a second, annular subchamber. The contour of the tubular separation element viewed in cross section is conformal with the contour of the interior wall of the container; they are, for example, both circular or both elliptical. In a further development of this embodiment according to the invention, a plurality of separation elements are present and are all configured as tubes having various diameters and are arranged coaxially. Their contours viewed in cross section are likewise conformal with the contour of the interior wall of the container.

According to one or more embodiments, the feed device comprises at least one inlet in the container wall and at least one inlet shut-off element. In one or more embodiments, the feed device comprises components which distribute the gas flowing in through the at least one inlet over all subchambers in a directed manner, e.g. a deflection element or a distributor device. In a further advantageous embodiment, the feed device comprises a plurality of passages through the container wall through which the inflowing gas is directed to the channel-shaped subchambers.

In one or more embodiments, the inflowing amount of gas is distributed over the channel-shaped subchambers in such a way that the ratios of the individual amounts of gas to one another correspond to the ratios of the cross-sectional areas of the subchambers.

The invention further provides a method of taking gas from a sorption store according to the invention, wherein a heat transfer medium whose temperature is greater than the temperature of the gas in the channel-shaped subchambers flows through the channel walls.

Compared to the prior art, the sorption store of the invention makes faster heat transport from the adsorption medium or into the adsorption medium possible. This significantly decreases the time required for charging of the store with a given amount of gas. As an alternative, the store can be charged with a larger amount of gas in a given time. When taking gas from the store, the invention makes rapid and constant provision of gas possible. For this purpose, the channel walls are heated, for example in the case of the double-walled configuration using a heat transfer medium whose temperature is greater than the temperature of the gas in the channel-shaped subchambers is passed through the double wall. The sorption store of the invention is simple to construct and as a result of its compact construction is particularly suitable for mobile applications, for example in motor vehicles. The embodiment with double channel walls has the additional advantage that the heat transfer medium merely has to be changed or its temperature altered appropriately to change from cooling to heating. This embodiment is therefore suitable for mobile use both during filling and in the driving mode.

The invention is illustrated below with the aid of the drawings; the drawings are to be interpreted as in-principle depictions. They do not restrict the invention, for example in respect of specific dimensions or configurational variants of components. In the interest of clarity, they are generally not to scale, especially in respect of length and width ratios.

LIST OF REFERENCE NUMERALS USED IN THE FIGURES

10 . . . container
15 . . . separation element
21 . . . inlet
22 . . . inlet shut-off element
23 . . . outlet
24 . . . outlet shut-off element
25 . . . inflow tube
30 . . . first subchamber
31 . . . second subchamber
40 . . . adsorption medium
50 . . . circulation circuit

51 . . . compressor

52 . . . heat exchanger

Figure 1:
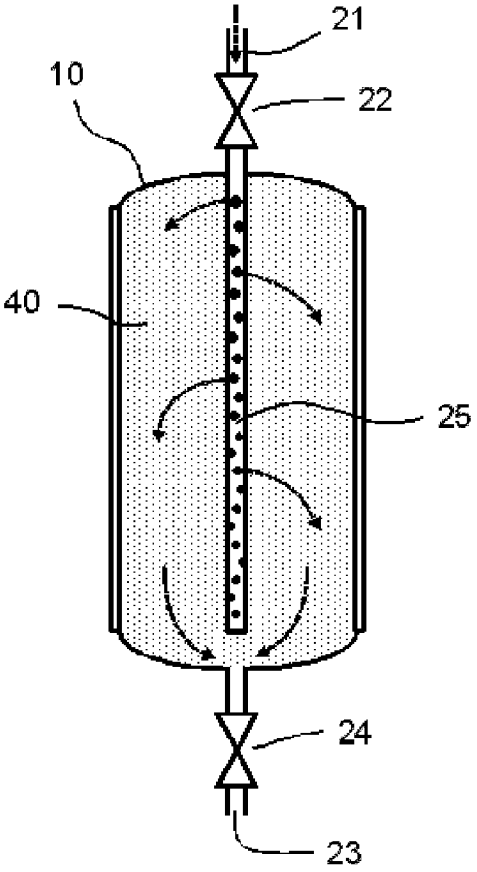
FIG. 1 depicts an embodiment of a sorption store having a perforated inflow tube for carrying out the method of the invention.
Figure 4:
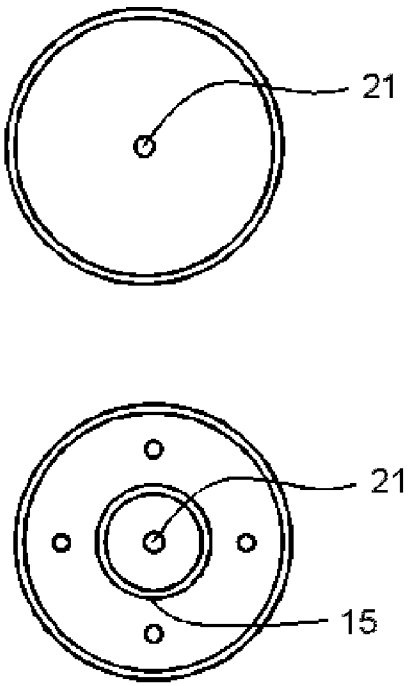
FIG. 4 depicts cross sections of the embodiments of FIGS. 1 to 3
Figure 3:
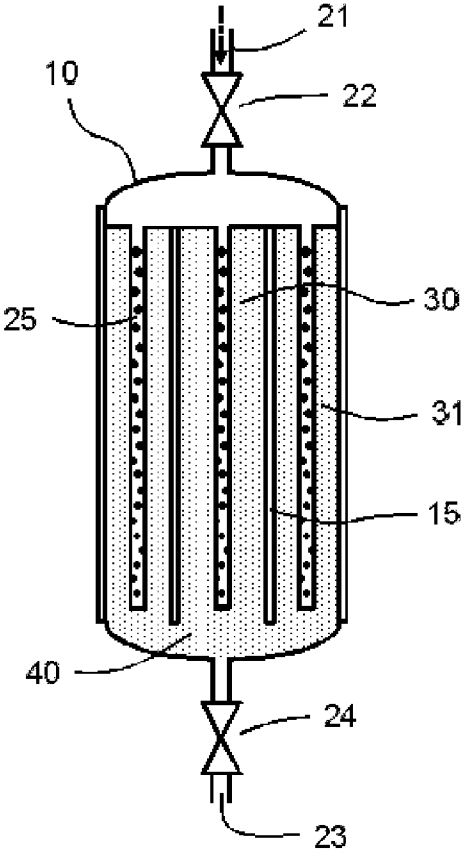
FIG. 3 depicts an embodiment of a sorption store according to the invention having two channel-shaped subchambers and a plurality of perforated inflow tubes.

FIGS. 1 to 4 show schematic sections through sorption stores. The illustrated sorption stores have an essentially cylindrical container 10. FIGS. 1 to 3 each depict longitudinal sections through the axis of the cylinder, and FIG. 4 shows corresponding cross sections perpendicular to the axis of the cylinder.

FIG. 1 shows an embodiment of a sorption store for carrying out the method of the invention. Referring to FIG. 1, the container 10 has a circular cross section and has passages through the container wall for flow of gas at both end faces. At the upper end face, there is an inlet 21 which can be shut off by means of an inlet shut-off element 22. At the lower end face, there is an outlet 23 having an outlet shut-off element 24. The interior of the container 10 is completely filled with an adsorption medium 40. From the inlet-end passage in the container wall, an inflow tube 25 extends downward coaxially with the axis of the cylinder. The inflow tube is closed at the bottom and perforated over its circumference, with the diameter of the exit openings decreasing from the top downward. The container wall is configured as a double wall to allow a heat transfer medium to flow through it. Corresponding inflow and outflow connections for a heat transfer medium are provided, but not shown in the drawing.

The broken-line arrows symbolize the gas flow within the container. Gas flowing in through the inlet 21 exits from the openings in the inflow tube 25 into the adsorption medium 40 and flows radially to the container wall and downward in the direction of the outlet 23. Part of the gas is adsorbed on the adsorption medium 40 and the remainder leaves the container 10 through the outlet 23. Compared to unmodified flow of the contents of the container from the top downward, the perforated inflow tube 25 results in a more uniform flow and a more homogeneous temperature distribution.

An alternative embodiment of a sorption store according to the invention is depicted in FIG. 2. Referring to FIG. 2, the container 10 has a circular cross section and has passages through the container wall at both end faces. At the upper end face, there is an inlet 21 which can be shut off by means of an inlet shut-off element 22. At the lower end face, there is an outlet 23 having an outlet shut-off element 24. In the interior of the container 10, there is a separation element 15 which is configured as a tube having a circular cross section and is arranged coaxially to the axis of the cylinder. The interior space of the tube forms a first channel-shaped subchamber 30. The space between the outer wall of the tube and the interior wall of the container forms a second, annular subchamber 31. The separation element 15 has a spacing from both end faces. In the example shown, the two subchambers 30, 31 are completely filled with an adsorption medium 40. On the end facing the inlet 21, the subchambers 30, 31 are bounded by a covering plate which extends over the entire cross section of the container. In the example shown, five openings through which gas can flow into the subchambers are present in the covering plate. The covering plate functions as flow equalizer which ensures uniform flow of gas into the subchambers 30, 31. The openings depicted are illustrative and can also have a different configuration. For example, annular or interrupted annular openings can be present in the annular outer region of the covering plate.

The broken-line arrows symbolize the gas flow within the container. Inflowing gas firstly goes into the space which is not filled with adsorption medium between the upper passage through the container wall and the covering plate and becomes uniformly distributed there. The gas flows through the openings in the covering plate into the two subchambers 30, 31 where it adsorbs on the adsorption medium. The adsorption medium and the surrounding gas heat up as a result of the adsorption. The container wall and the separation element 15 are configured as double walls and a heat transfer medium flows through them to effect cooling, so that a radial temperature gradient is established between the middle of the channel-shaped subchambers and the peripheries thereof. The flow, according to the invention, through the container 10 during charging results in removal of the heat evolved in adsorption and thus lower maximum temperatures in the adsorption medium.

FIG. 3 shows a further embodiment of a sorption store according to the invention. Referring to FIG. 3, the configuration of the store corresponds to that shown in FIG. 2 with the modification that a perforated inflow tube 25 extends coaxially to the axis of the cylinder downward from the openings in the covering plate. As in the embodiment of FIG. 1, the inflow tubes affect a more uniform flow of the contents of the container and a more homogeneous temperature distribution in the adsorption medium.

FIG. 4 shows cross sections perpendicular to the axis of the cylinder. Referring to FIG. 4, the upper drawing shows a cross section through the sorption store of FIG. 1, and the lower drawing shows a cross section through a sorption store as per FIG. 2 or 3.

Figure 5:
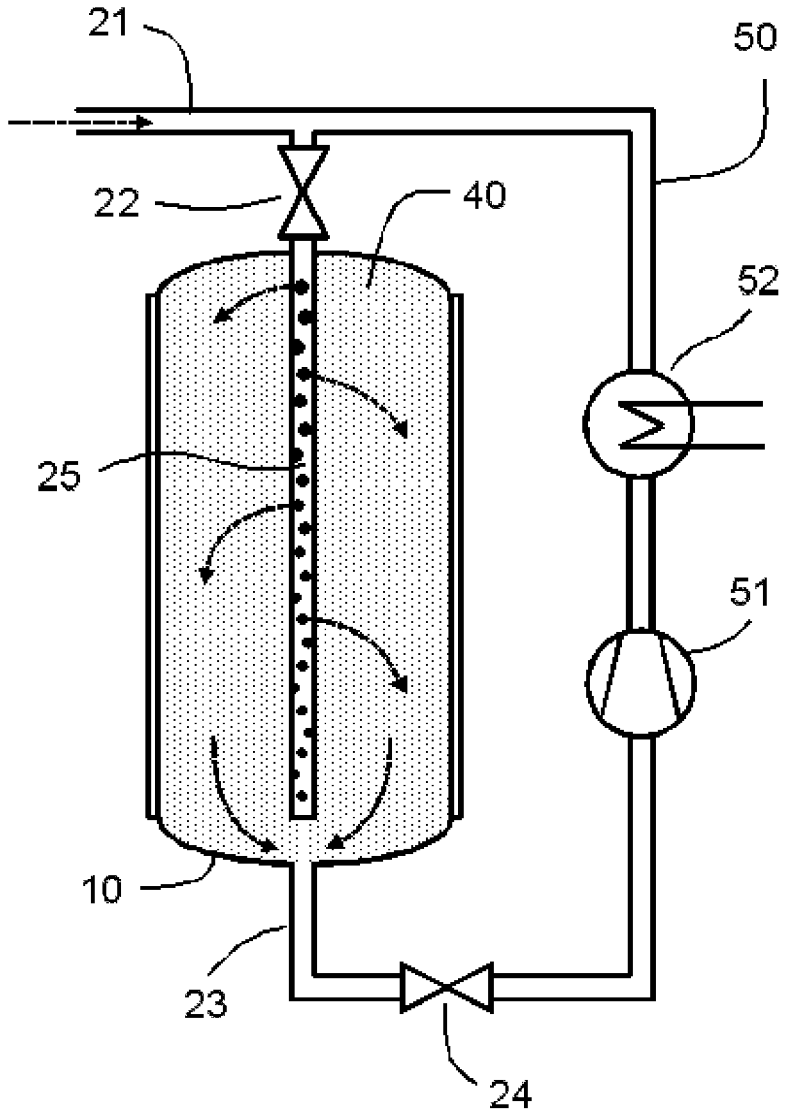
FIG. 5 depicts an embodiment of a sorption store according to the invention having a circulation circuit.

FIG. 5 shows an embodiment of the sorption store of FIG. 1 integrated into a circulation circuit 50. Referring to FIG. 5, the outlet 23 is connected via the outlet shut-off element 24 to the suction side of a compressor 51 whose pressure side is in turn connected via a heat exchanger 52 to the inlet 21 of the container 10. Flow according to the invention through the sorption store is ensured by the circulation circuit. Only the amount of gas which is adsorbed on the adsorption material is fed in via the external circuit 21. In mobile use, for example in a motor vehicle, this embodiment has the advantage that no external gas network has to be used to maintain the flow. As a result, it is possible to dispense with complicated filter devices as have to be provided, for example, at filling stations in order to avoid contamination of the filling station pipe system.

The invention is now described with reference to the following examples.

EXAMPLES

Results of simulation calculations carried out using the program OpenFOAM (from ENGYS) are shown below. The calculations are based on the following assumptions:

- The bed of pellets can be regarded as a porous medium and as a homogeneous phase separate from the gas phase. It is thus not necessary for each individual pellet to be numerically resolved.
- All pellets have the same properties in respect of size, permeability, density, heat capacity, conductivity, enthalpy of adsorption and adsorption kinetics.
- The flow effects in respect of the heat conduction of the bed can be described by known correlations (e.g. VDI-Warmeatlas, 10th edition, Springer-Verlag, Heidelberg 2006, section Mh3)

The calculations are based on a cylindrical container having a circular cross section, an internal length of 100 cm and an internal diameter of 17 cm. In a manner similar to the embodiment of FIG. 2, in the interior of the container, a tube having a circular cross section is installed as separation element concentrically to the axis of the cylinder. It has a double wall and an internal diameter of 5 cm. Its wall thickness is a total of 1 cm, and the gap width between the walls of the double wall is 3 mm. The interior of the container is thus divided in a channel pair into two parallel, channel-shaped subchambers. The spacings of the channel walls are 5 cm in both subchambers. The spacing between the tube ends and the respective end-face interior surfaces of the container is 1 cm. The container wall is likewise a double wall having a wall thickness of a total of 1 cm, and the gap width between the walls of the double wall is 3 mm.

The container has a fill volume of 19 liters and is filled with pellets of a metal framework (MOF) of the type 177 as adsorption medium. The MOF type 177 comprises zinc clusters which are joined via 1,3,5-tris(4-carboxyphenyl)benzene as organic linker molecule. The specific surface area (Langmuir) of the MOF is in the range from 4000 to 5000 $m^2/g$. Further information on this type may be found in U.S. Pat. No. 7,652,132 B2. The pellets have a cylindrical shape with a length of 3 mm and a diameter of 3 mm. Their permeability is $3.10^{-16}$ $m^2$. The ratio of permeability to smallest pellet diameter is thus $10^{-13}$ $m^2/m$. The porosity of the bed is 0.47.

The filling of the container with pure methane, which is fed in with a temperature of 27° C., is examined. The predetermined final pressure is 90 bar absolute. A heat transfer medium flows through the container wall and the respective separation elements in such a way that a constant wall temperature of 27° C. is established. Under these conditions, the container can be filled with a maximum of 2 kg of methane.

Figure 6:
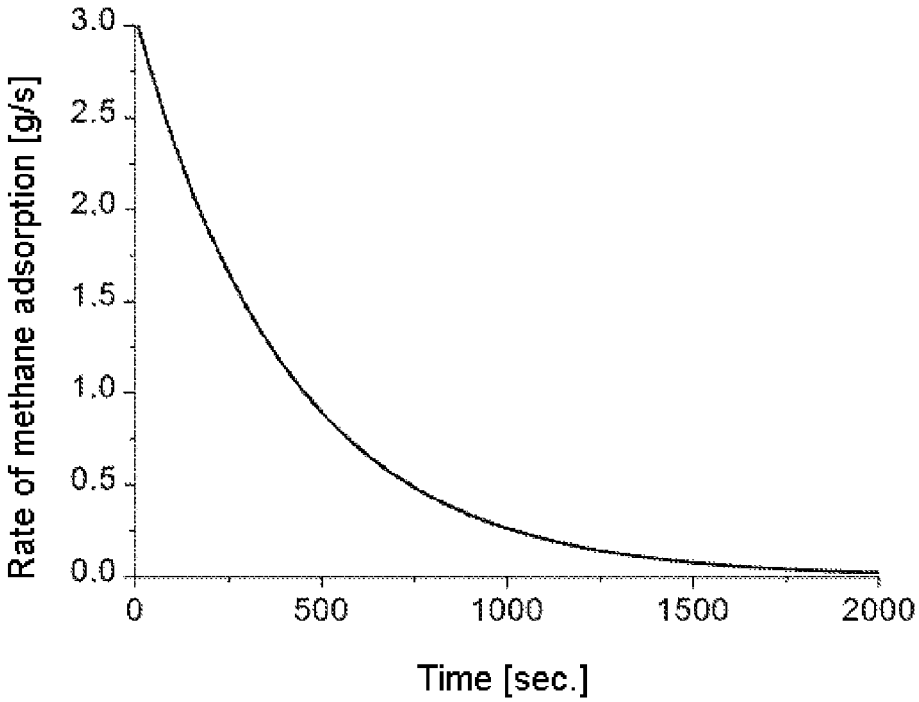
FIG. 6 is a graph of the adsorption rate of the simulation example

FIG. 6 shows the adsorption rate for methane for the adsorption medium simulated at a pressure of 90 bar and a temperature of 27° C. This curve is typical of adsorption media such as MOFs, zeolites, or activated carbon.

Figure 7:
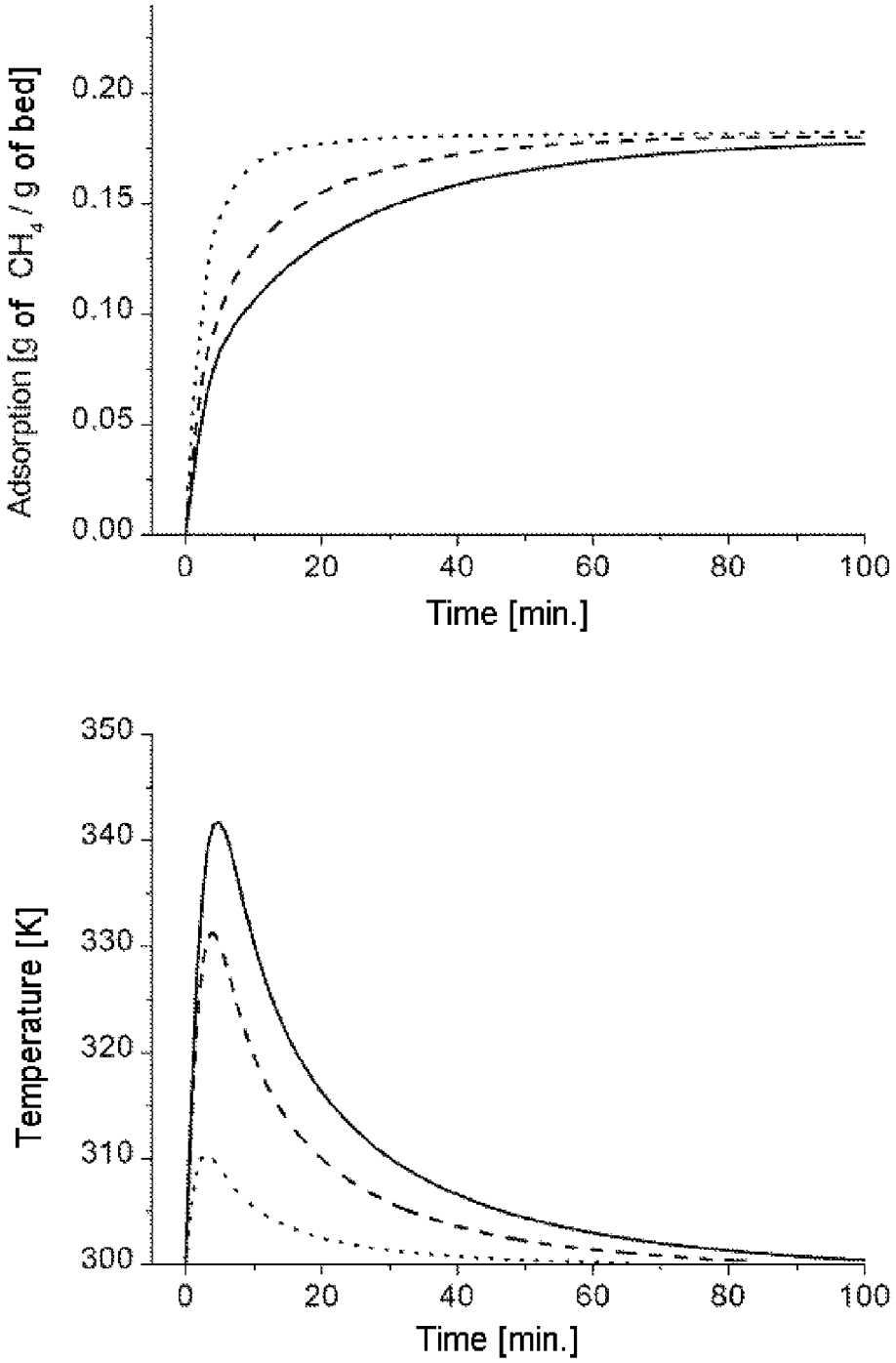
FIG. 7 is a graph of the loading and temperature curves of the simulation example

The drawings in FIG. 7 show the results of three scenarios. In the comparative scenario (solid curve), the gas is fed from the beginning at a constant pressure of 90 bar into the above-described container. The outlet shut-off element remains closed during the entire charging time and no flow through the container takes place. The temperature in the bed of pellet reaches its maximum of about 342 K after about 8 minutes.

In the first scenario according to the invention (broken-line curve in FIG. 7), the same container configuration as in the comparative scenario is used as a basis. However, the outlet shut-off element is quickly opened after the first pressure rise, so that flow through the container is established. The flow rate is measured and regulated to five times the adsorption rate over the entire duration of charging. As can be seen from the upper graph in FIG. 7, the adsorption medium is loaded significantly more quickly than in the comparative example. The temperature maximum in the bed is reached after about 7 minutes and is, at about 332 K, significantly lower than in the comparative example (lower graph in FIG. 7).

In the second scenario according to the invention (dotted curve in FIG. 7), the scenario is altered from the first scenario according to the invention in that the flow is regulated to twenty times the adsorption rate. As can be seen from the two graphs of FIG. 7, this results in a further significant shortening of the loading time and, also, an earlier and significantly lower temperature maximum of about 311 K.

The simulation results demonstrate that the heat of adsorption is removed effectively by means of the mode of operation according to the invention, which leads to a reduced temperature maximum in the adsorption medium and more rapid loading with the gas to be stored.

What is claimed is:

1. A method of charging a sorption store with a gas, wherein the sorption store comprises a closed container which is at least partly filled with an adsorption medium and has an inlet and an outlet which can each be closed by a shut-off element, the method comprising the steps:

(a) closing of the outlet shut-off element and opening of the inlet shut-off element, (b) introduction of the gas to be stored under a predetermined pressure through the inlet, (c) rapid opening of the outlet shut-off element with the inlet shut-off element open so that a gas flow having a predetermined flow rate is established in the container, (d) reduction of the flow rate as a function of the adsorption rate of the gas adsorbed in the store, and (e) complete closing of the outlet shut-off element.

2. The method according to claim 1, wherein the container has at least two parallel, channel-shaped subchambers which are each at least partly filled with the adsorption medium and whose channel walls are cooled in its interior.

3. The method according to claim 2, wherein the channel walls of the channel-shaped subchambers are configured as double walls and a heat transfer medium flows through them.

4. The method according to claim 2, wherein the spacing of the channel walls in each channel-shaped subchamber is from 2 cm to 8 cm.

5. The method according to claim 1, wherein the gas stream flowing into the container or out of the container is measured by means of a flow sensor and the flow rate of the gas in the container is set as a predetermined multiple of the adsorption rate over time.

6. The method according to claim 5, wherein the predetermined multiple is from 1.5 to 100.

7. The method according to claim 1, wherein the temperature of the gas stream is measured at at least one point in the interior of the container and is matched to the flow rate of the gas in the container when required in such a way that a predetermined maximum temperature is not exceeded.

8. The method according to claim 1, wherein the porosity of the adsorption medium is at least 0.2.

9. The method according to claim 1, wherein the adsorption medium is present as a bed of pellets and the ratio of the permeability of the pellets to the smallest pellet diameter is at least $10^{-14}$ $m^2/m$.

10. The method according to claim 1, wherein the adsorption medium is selected from zeolite, activated carbon, or metal organic frameworks.

11. The method according to claim 5, wherein the predetermined multiple is from 3 to 40.

12. The method according to claim 1, wherein the temperature of the gas stream is measured in at least one channel-shaped subchamber and is matched to the flow rate of the gas in the container when required in such a way that a predetermined maximum temperature is not exceeded.

* * * * *